US006443087B1

(12) United States Patent
Stecker, Sr.

(10) Patent No.: US 6,443,087 B1
(45) Date of Patent: Sep. 3, 2002

(54) UNDERWATER DIVE VEHICLE

(76) Inventor: David W. Stecker, Sr., 23W540 Bryn Mawr, Roselle, IL (US) 60172

( * ) Notice: Subject to any disclaimer, the term of this patent is extended or adjusted under 35 U.S.C. 154(b) by 22 days.

(21) Appl. No.: 09/909,568

(22) Filed: Jul. 20, 2001

Related U.S. Application Data

(60) Provisional application No. 60/220,121, filed on Jul. 21, 2000.

(51) Int. Cl.[7] ..... B63C 11/46

(52) U.S. Cl. ..... 114/315; 114/333; 114/338

(58) Field of Search ..... 114/315, 316, 114/312, 313, 121, 331, 337, 338; 440/6

(56) References Cited

U.S. PATENT DOCUMENTS 4,864,959 A * 9/1989 Takamizawa et al. ..... 114/315
4,996,938 A * 3/1991 Cameron et al. ..... 114/315
5,379,714 A * 1/1995 Lewis et al. ..... 114/315
6,021,731 A * 2/2000 French et al. ..... 114/121
6,065,419 A * 5/2000 Stecker, Sr. ..... 114/315
6,131,531 A * 10/2000 McCanna et al. ..... 114/331
6,321,676 B1 * 11/2001 Kohnen et al. ..... 114/312

* cited by examiner

*Primary Examiner*—Stephen Avila
(74) *Attorney, Agent, or Firm*—Lee, Mann, Smith, McWilliams, Sweeney and Ohlson

(57) ABSTRACT

The underwater vehicle disclosed has a selectively energizable propulsion unit for forcible driving the vehicle through the water and at least one resilient gas filled buoyancy element and at least one rigid buoyancy element which is in open contact with the surrounding water when the vehicle is in the water. The volume of the gas in the buoyancy element provides sufficient displacement of the water to keep the vehicle afloat at the surface when unattended or to support a diver. When the vehicle is submerged water pressure will act directly upon and tend to compress the resilient buoyancy element and the gas contained. This reduces the volume of the gas within the buoyancy element and thus reduces buoyancy of that element and the rigid buoyancy element then takes over and becomes neutrally buoyant or slightly positive. Sealed housings such as those surrounding parts of the propulsion unit are filled with a non-conductive and non-corrosive liquid to prevent distortion and subsequent leaking of the seals, and non-moveable electrical components are encased in waterproof epoxy.

4 Claims, 4 Drawing Sheets

UNDERWATER DIVE VEHICLE

RELATED APPLICATIONS

This application claims priority from provisional application Ser. No. 60/220,121 filed Jul. 21, 2000.

Background of the Invention

This invention relates to an underwater dive vehicle of the type which may be used for propelling divers to underwater locations, and more particularly to a powered underwater vehicle in which the buoyancy may be reduced as the vehicle descends to greater depths in the water and remains neutrally buoyant at depth.

This is an improvement over the dive vehicle described and claimed in my U.S. Pat. No. 6,065,419 dated May 23, 2000 and entitled Underwater Dive Vehicle. In that patent there is disclosed and claimed a dive vehicle which employs a flexible and resilient gas filled buoyancy element which may be in the form of a resilient bladder or a closed cell resilient sponge material. The present invention incorporates a plurality of rigid, foamed substantially incompressible second buoyancy elements which may be selectively attached to or removed from the vehicle to adjust buoyancy and thereby achieve neutral buoyancy according to the weight of the vehicle and its loan and/or according to the buoyancy of the waters surrounding the vehicle.

Small powered underwater dive vehicles for taking one or two divers to underwater locations usually comprise a motor having a drive shaft which is operably connected to a propeller, a battery for energizing the motor and a control switch for selectively energizing the motor. Such devices are illustrated and described, for example, in U.S. Pat. No. 5,379,714, No. 4,864,959 and No. 4,996,938. Such vehicles, however, have encountered problems of buoyancy and leakage. Leakage is a particular problem when the vehicle is taken to substantial depths where the pressure may be several atmospheres. For every 10 meters of descent in sea water, an additional atmosphere of pressure is placed on the vehicle and its parts. Thus, at a depth of 30 meters or approximately 100 feet, there are 3 atmospheres of pressure, and the pressure corresponding increases as greater depths are attained. Underwater dive vehicles should be designed to withstand 15 atmospheres of pressure or the pressure that would be encountered at a depth of 500 feet.

The greater the pressure, the more stress there is on the seals which are in place to keep water out of such areas as the buoyancy chambers, the housings surrounding the batteries and the motor. U.S. Pat. No. 4,864,959 recognizes this problem and is directed to detecting leaks of sea water into the battery or motor compartments of underwater dive vehicles. That patent also suggests that water absorbing sheets be stuffed around mechanical parts and the battery and clutch compartments. Another moisture detection system for an underwater dive vehicle is disclosed in U.S. Pat. No. 4,996,938.

Another problem with underwater dive vehicles has to do with the buoyancy of the vehicle. It is highly desirable that at the surface the vehicle have a positive buoyancy so that the unattended vehicle may float on the surface and preferably also support a diver at the surface. However, during the dive., the operator of the vehicle should not be constantly fighting buoyancy.

It is thus an object of the present invention to provide a solution to the water leaks which have heretofore plagued underwater dive vehicles by so constructing the vehicle that the water tight seals are not placed under stress even when the vehicle submerges to depths of several hundred feet.

It is another object of this invention to provide an underwater vehicle the frame of which is open to the water and which thus eliminates any pressure on the frame.

It is a further object of this invention to provide an underwater dive vehicle that has a positive buoyancy at the water surface but which buoyancy may be automatically reduced as the vehicle is taken to greater depths and then becomes neutrally buoyant at depth.

It is an additional object of this invention to provide an underwater vehicle that has an easily adjustable buoyancy which will permit the vehicle selectively to float at the surface of the water, to reduce its buoyancy as the vehicle is descending in the water, to remain at a neutral buoyancy at any selected depth automatically.

SUMMARY Of THE INVENTION

The underwater vehicle constructed in accordance with this invention comprises a selectively energizable propulsion unit for forcibly driving said vehicle through the water, and buoyancy means including at least one resilient gas filled buoyancy element and at least one rigid buoyancy element preferably disposed within a buoyancy chamber. There may be one or more buoyancy chambers, each containing one or more buoyancy elements. Each buoyancy chamber is open and thus the buoyancy element is exposed to and is in contact with the surrounding water when said vehicle is in the water, and the volume of gas in said buoyancy element provides sufficient displacement of the water to keep the unattended vehicle afloat at the surface. Since the buoyancy element is exposed and thus in direct contact with the water, when said vehicle is forced downwardly in the water by the propulsion unit the increasing water pressure will act upon and compress the buoyancy element and the gas contained therein reducing the volume of the gas and thus automatically reducing the buoyancy of the buoyancy element until the rigid buoyancy element takes over. The buoyancy element may be a very resilient bladder of rubber or Neoprene which may be conveniently filled with any gas such as air. In the alternative the buoyancy element may be constructed of a foamed, resilient plastic material, such as foamed neoprene, which has discrete isolated pockets or closed cells of entrapped air.

The rigid element may be a rigid foam, for example, an extruded polystyrene foam having a high compressive strength preferably of on the order of between 60 psi and 100 psi. The 60 psi will allow the vehicle to remain neutral to a depth of approximately 141 feet sea water and the 100 psi approximately 235 feet sea water. For greater depths a more rigid foam could be used incased in a rigid tube that is filled with a liquid and sealed or a liquid foam and then sealed. The liquid foam would be something like a two part poor foam like the product seafoam which expands and becomes rigid and would fill all voids in the tube. The vehicle could be coated or filled with a rigid foam and set at neutral buoyancy but would be limited to either fresh or salt water because of different buoyancies of the water.

The advantage of buoyancy chambers is that the buoyancy can be easily adjusted by removing or adding tubes to increase or decrease buoyancy which means that weight or size is no longer a problem nor is going from fresh water to sea water.

Since vehicles have different weights, in order to achieve a neutral buoyancy, you must adjust rigid buoyancy elements first. Once neutral buoyancy is achieved the vehicle will remain neutral to the depth of the rating of the rigid buoyancy you have used. If a positive buoyancy is desired you would then add a resilient gas filled buoyancy element. Therefore one could have any buoyancy affect be it positive, negative or neutral automatically by adding or removing buoyancy. It should also be noted that vehicles at neutral buoyancy are virtually weightless and require less strain on motors to move them through water. For example, submarines, if there was a problem, the vehicle would not sink to deeper depths and implode, but remain neutral and recoverable. Whereas, if an inflatable bladder were added the damaged vehicle could be raised to the surface in an emergency. In one form of the invention the vehicle has a central frame, which is preferably hollow, and the buoyancy means includes a pair of hollow outriggers, open preferably at one or both ends and having arms connected to the central frame of the vehicle. This connection may be fixed or it may be a pivotal connection permitting the outriggers to be pivotally swung between an inwardly folded position overlying the vehicle central frame and an outwardly extended position laterally outward from the frame on opposite sides thereof If the connection is a pivotal connection means is provided for locking the outriggers in their desired position relative to the frame. A buoyancy element, in the form of either a resilient bladder or resilient foamed closed cell plastic is mounted within each of the outriggers and preferably also within the central frame and also a rigid buoyancy element, in the form of a rigid foam or foam filled tube or a rigid gas filled container.

In the preferred embodiment the propulsion unit includes an electric motor having an output shaft on which is mounted a propeller. An electric storage battery supplies the electric current for driving the motor, and a manually operable switch, which may be in the form of a push-button or joystick or turn switch, permits the motor to be selectively energized by the diver-operator. While not preferred, a jet propulsion unit could be employed.

It is preferred that all electrical terminals, such as the terminals for the battery and the motor be encased in a waterproof epoxy resin, so that the sea water will not come into contact with these terminals and cause corrosion. It is preferred that there be unique watertight battery connections and this is a feature of the invention.

The invention also features means for preventing water from entering sealed cavities of the vehicle. This is accomplished by filling those cavities with a non-conductive and noncorrosive liquid, such as transformer oil. Since liquids are substantially non-compressible, seals which are positioned to prevent the entry of sea water into the cavities of the vehicle will be supported by the liquid in the interior of the cavity and will not be distorted by the pressure of the sea water acting through the seal against a compressible and thus non-supporting gas within the cavity. In other words, with liquid in the interior of the cavity, the seal will not be moved inwardly in a manner which would otherwise cause it to distort or stress and permit leakage of sea water into the cavity.

DETAILED DESCRIPTION OF THE PREFERRED EMBODIMENTS

Figure 1:
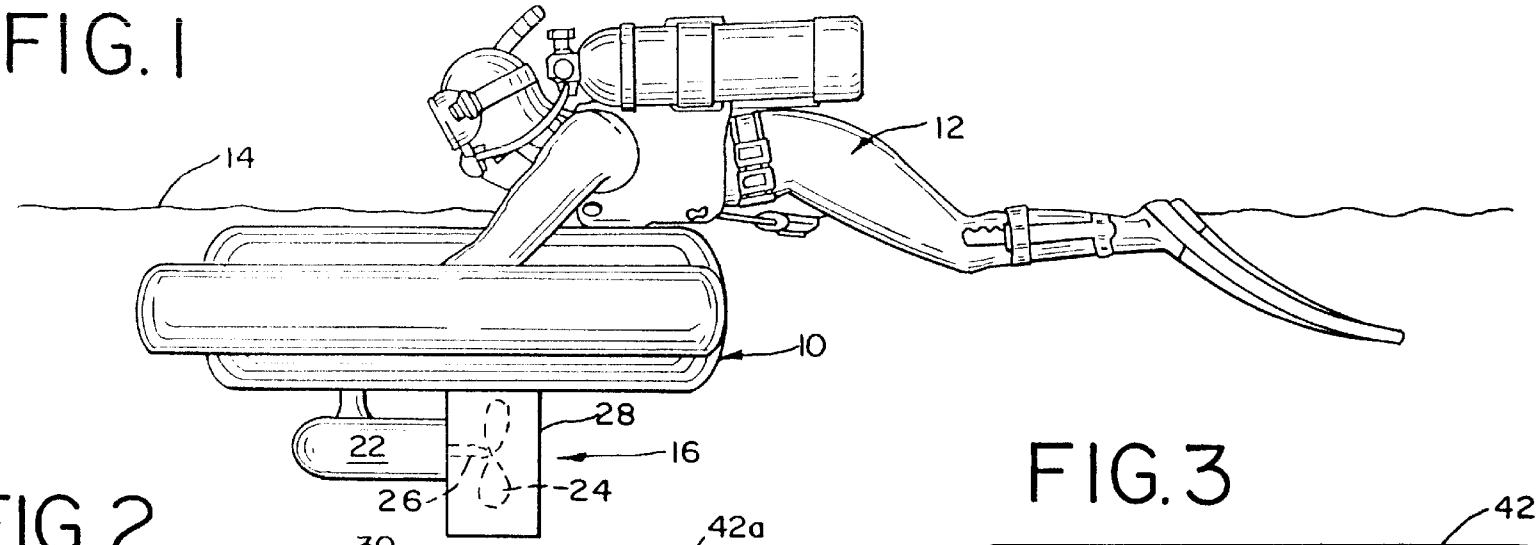
FIG. 1 is side elevational view of an underwater dive vehicle constructed in accordance with one embodiment of the invention, showing a diver on the vehicle at the surface of the water.

In FIG. 1 there is illustrated an underwater dive vehicle 10 constructed in accordance with this invention. The dive vehicle is being used by a diver 12 and in this figure it is illustrated at the surface of the water 14. Although described as a dive vehicle, it will be appreciated that the vehicle may also be used on the water surface to transport a diver to a dive location or for snorkeling.

Figure 2:
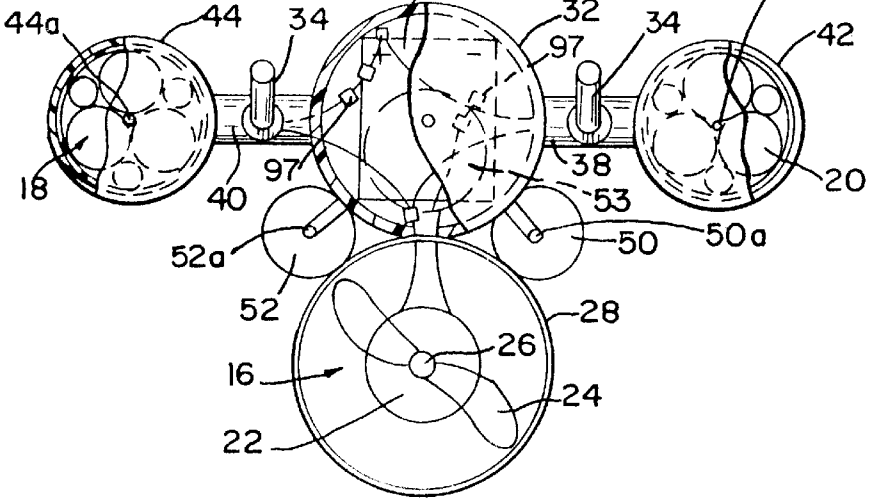
FIG. 2 is an end elevational view of the vehicle with portions of the buoyancy chambers and propulsion unit and battery compartments cut away to show the interiors thereof.

As best illustrated in FIG. 2, the dive vehicle comprises a selectively energizable propulsion unit 16 for forcibly driving the vehicle through the water. The vehicle also includes buoyancy means in the form of at least one and preferably two outwardly disposed gas filled compressible buoyancy elements 18 and 20 and one and preferably several substantially incompressible foamed buoyancy elements.

The selectively energizable propulsion unit preferably includes a motor 22 which drives a propellor 24 through a suitable and well-known connections such as a drive shaft 26. A standard battery driven trolling motor is quite satisfactory. A suitable protection cage 28 surrounds the propeller 24. A suitable sealed nickel-cadmium, dry cell or gel cell lead acid battery 30 housed within a central body or housing 32 provides the electrical energy for the motor 22 of the propulsion unit 16. The battery 30, which preferably has unique watertight connections later described, is selectively electrically connected to the propulsion unit 16 by means of suitable switches 34 and 36 which may be in the form of joysticks of the kind commonly used to operate underwater vehicles of this type. These switches may also be of other types such as for example, push button switches, but they should be capable of easy manipulation by the diver. The switches, indeed, may actually operate solenoids which close the circuit between the battery 30 and the propulsion unit if this is desired in order to minimize the electrical energy passing through these switches 34 and 36. If desired, only one switch may be employed, the other serving as a grip or a switch for operating a buoyancy control device which will be more fully hereinafter explained. If desired, a suitable well-known jet propulsion unit may be employed instead of the propeller diver propulsion unit.

Figure 3:
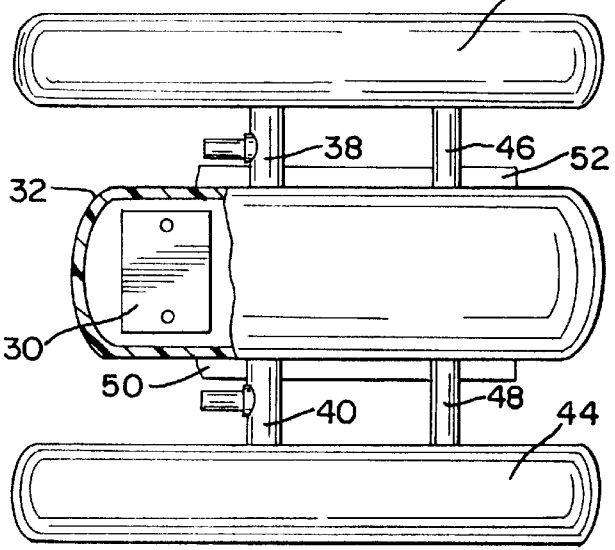
FIG. 3 is a top plan view of the vehicle with a portion of the battery compartment cut away to show the interior thereof.

In the vehicle illustrated in FIGS. 1, 2 and 3, the motor 22 of the propulsion unit 16 is mounted below the tubular central housing 32 and the drive shaft 26 extends rearwardly to operate the propeller 24. The switches 34 and 36 are mounted on hollow, tubular connecting arms 38 and 40 which connect the central housing 32 to outwardly disposed buoyancy element housings 42 and 44 on either side of the central housing 32, and a similar pair of rearwardly disposed connecting arms 46 and 48 also connect the rearward portion of the central housing 32 to the rearward portion of the buoyancy element housings 42 and 44 on either side thereof, as best shown in FIG. 3.

Compressible buoyancy elements 18 and 20 preferably are disposed within the buoyancy element housings 42 and 44, with each of the buoyancy element housings being open preferably at both ends so that the water may enter the housing and contact the compressible buoyancy elements when the vehicle is in the water. The compressible buoyancy elements 18 and 20 consist of elements which are substantially filled with air or other gas and which are highly resilient, compressible and flexible. Each buoyancy element may, for example, be a rubber or neoprene bladder which is filled with air, or it may be a very resilient and compressible closed cell foamed material such as foamed polyurethane, polyethylene, silicon sponge rubber, PVC, neoprene sponge rubber or the like. The material should be very resilient and compressible. Compressibility of about 25% at pressures between about 2.5 psi and 14 psi is satisfactory. The density should be as lows as possible. Alternatively, the buoyancy elements may be a combination of closed cell sponge material and inflatable bladders.

In FIG. 2 the forward openings 42*a* and 44*a* are provided in the buoyancy element housings 42 and 44 respectively. Similar openings are provided in the rear of these housings with the openings being such that the water may freely enter the housings 42 and 44. Preferably, the openings should just be large enough to assure the entry of water into the housings and to permit draining. Thus, the compressible buoyancy elements 18 and 20 are always subject to the pressure of the water at the depth at which the vehicle is being operated. In the case of a closed cell sponge such as neoprene sponge rubber, gases are entrapped in the discrete closed voids and when the vehicle is submerged, the buoyancy element will be subject to the pressure of the water which will tend to compress the entrapped gas in the buoyancy element, with the pressure increasing as the depth increases. When the vehicle is brought to the surface the water may be easily drained from the buoyancy element housings 42 and 44 through the forward openings 42*a* and 44*a* or the rearward openings (not shown).

The invention contemplates an adjustment of buoyancy, if desired. For such adjustment, two rigid, substantially incompressible buoyancy elements 50 and 52 are provided, as shown in FIGS. 2 and 3. These may be contained within housings like housing 42 and 44 that are open at both ends and may be removably connected the vehicle. These incompressible foam buoyancy elements may be in sections or pieces which can be individually added or removed and they may be combined with compressible buoyancy elements. This permits the diver to adjust the buoyancy by adding or removing rigid buoyancy elements and/or compressible buoyancy elements. This may be desirable if, for example, there is excessive weight on the vehicle such as when two divers are using the vehicle or heavy objects are being carried or mounted on the vehicle. It is preferred that the incompressible foam buoyancy elements provide neutral buoyancy of the vehicle at the surface.

At the surface of the water the compressible buoyancy elements 18 and 20, consisting of the bladder or foamed material or combination of bladder and foamed material, will contain sufficient entrapped air so that the vehicle will remain buoyant on the surface or at the surface even if the vehicle were unattended. However, as the vehicle is driven to greater depths, the gas in the compressible buoyancy elements 18 and 20 will compress and ultimately the unit will become negatively buoyant because the air in these elements will be compressed and the buoyancy elements will become very small. At this point the rigid and incompressible foam buoyancy elements would take over and permit the vehicle to become neutrally buoyant at the desired depth even when the motor is not running.

In order to further offset the weight of the vehicle, the motor and the battery, the interior of the central housing 32 which contains the battery 30 may have an additional compressible buoyancy element 53. The central housing has openings to allow the water into the housing to contact the buoyancy element 53 in the same manner as the buoyancy housings 42 and 44.

One other aspect of the invention which is preferred is that all of the wiring including the terminals of the battery be coated with a waterproof epoxy preventing water from contacting the terminals or bare wires, and that all voids be filled with a non-compressible liquid. Thus, even though the interior of the central housing is open to the water, the water will not contact the battery terminals within the central housing.

It is preferred that all housing voids containing moving parts be filled with a non conductive oil such as transformer oil or a silicon grease which is non-compressible at operational depths. This eliminates entrapped air which is compressible. With the housing for the motor 22, for example, filled with a non-compressible non-conductive liquid such as transmission fluid, the seals between sections of the motor housing will have minimum strain placed upon them because the oil or fluid on the interior of the housing is non-compressible and will act internally against the seals to prevent movement. If air was entrapped within the housing this would be extremely compressible, would not resist movement of the seals, and thus would place an enormous strain upon the seals in order to keep the sea water out at operational depths. It is also preferred that all voids even in the wires be filled with the non-conductive non-corrosive liquid to prevent the entry of sea water into those voids.

Figure 4:
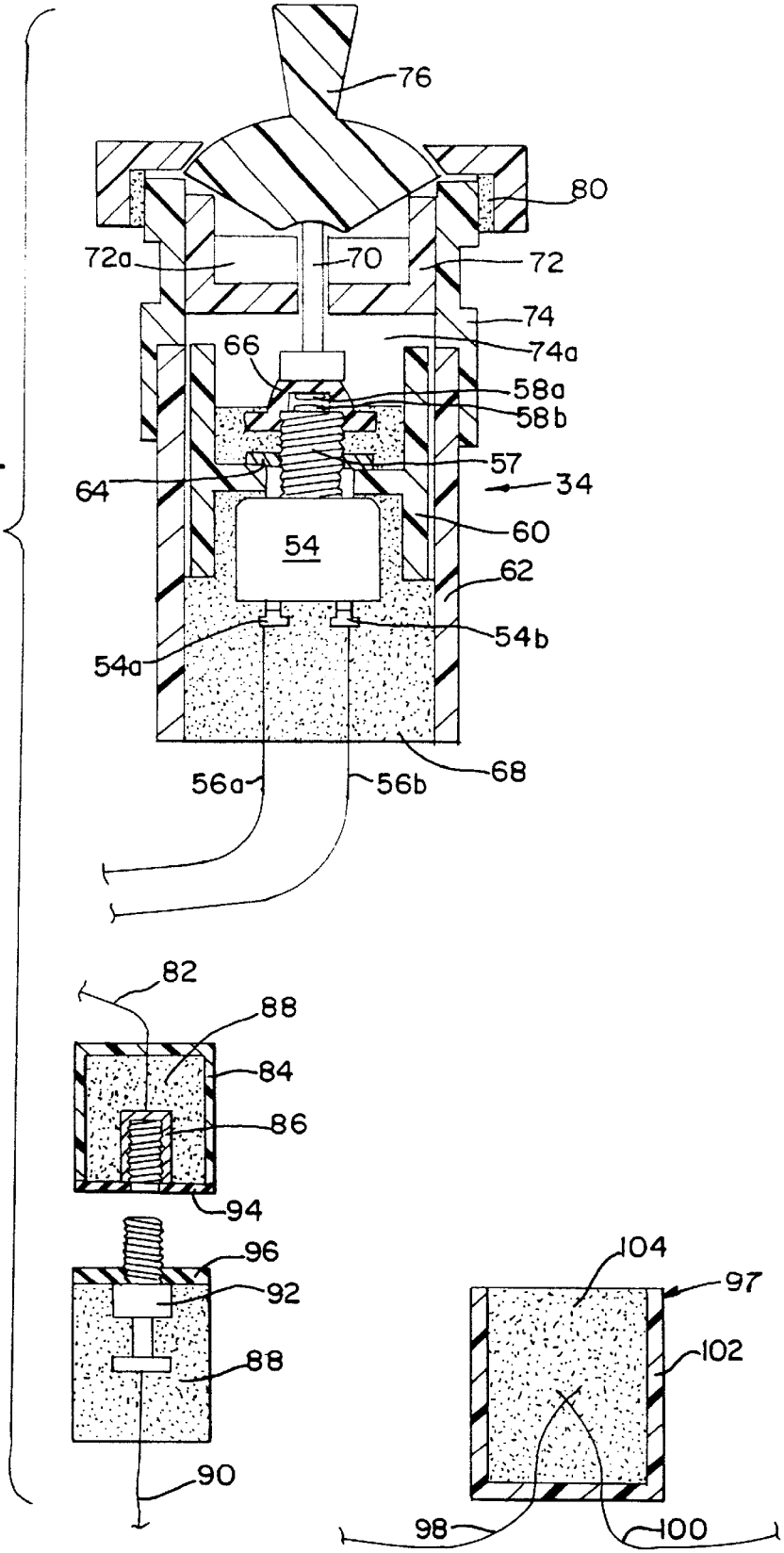
FIG. 4 is an enlarged sectional elevational view of some of the electrical components of the vehicle, namely, the control switch for the motor and two electrical couplings.

An example of this is shown in FIG. 4 in which a typical joys tick switch 34 is illustrated. The switch includes a switch assembly 54 having a pair of terminals 54a and 54b from which wires 56*a* and 56*b* extend. The switch assembly has a threaded upper portion 57 at the top of which is a movable contact 58*a* and a fixed contact 58*b*. The switch assembly 54 is mounted on a PVC switch mounting 60 which is adhesively secured to the outer switch housing 62. The mounting of the switch assembly 54 to the switch mounting is by means of an anchor nut 64 and over the movable and fixed contacts 58*a* and 58*b* of the switch is threaded a flexible neoprene or rubber seal nut 66. The interior of the seal nut 64 surrounding the movable and fixed contacts 58*a* and 58*b* is filled with a silicon grease. The entire switch assembly 54 including the terminals 54*a* and 54*b* and the threaded upper portion 54*c* are encased in a waterproof epoxy 68 which also surrounds the lower portion of the rubber seal nut 66. In contact with the rubber seal nut 64 is a switch activator rod 70 which is slidably mounted in a support 72 glued to the upper switch housing 74, that housing being in turn adhesively secured to the lower switch housing 62. The switch activator rod 70 is operated by the joys tick switch operator 76 which is journaled between the upper portion of the support 70 and the cap 78. The interiors 72*a* and 74*a* of the support 72 and of the upper switch housing 74 respectively, are open to water. Due to the presence of the silicon grease when the switch 34 is subjected to high water pressure, the silicon grease will not compress and therefore there is a relatively small strain, if any, on the rubber seal nut 66. However, the pressure exerted by the switch activator rod 70 on the seal nut 66 and the contacts 58*a* and 58*b* under force from the joys tick switch operator is sufficient to compress the rubber seal nut 66 and close the contacts 58*a* and 58*b*.

FIG. 4 also shows a connection between two electrical connectors, a wire 82 extends through a connector housing 84 and is electrically connected to an internally threaded brass coupler 86. The housing 84 is filled with a waterproof epoxy 88. A second wire 90 is electrically connected to a second externally threaded coupler 92 and the area surrounding the lower portion of the coupler 92 is encased in epoxy 88. In this instance no housing is shown because it is merely another example of encasing the coupler or electrical connector in epoxy and it is not important that there be a housing surrounding the epoxy. It will be noted, however, that the lower end of the internally threaded brass coupler 86 has a rubber seal 94 and a similar rubber seal 96 surrounds the upper externally threaded portion of the brass coupler 92. Thus, when the two are threadedly engaged, and the seals 94 and 96 are compressed, there will be an electrical connection and there will be a seal with no possibility of sea water contacting the electrical connections of these two couplers. Also shown in FIG. 4 is an epoxy seal 97 for the ends of two electrical wires 98 and 100 which are disposed within a housing 102 which is filled with waterproof epoxy 104. Thus, the ends of the wires 98 and 100 are prevented from contact with the sea water. This type of seal 97 is shown also in FIG. 2. These are examples of the use of waterproof epoxy to prevent water from adversely affecting electrical connections.

Figure 5:
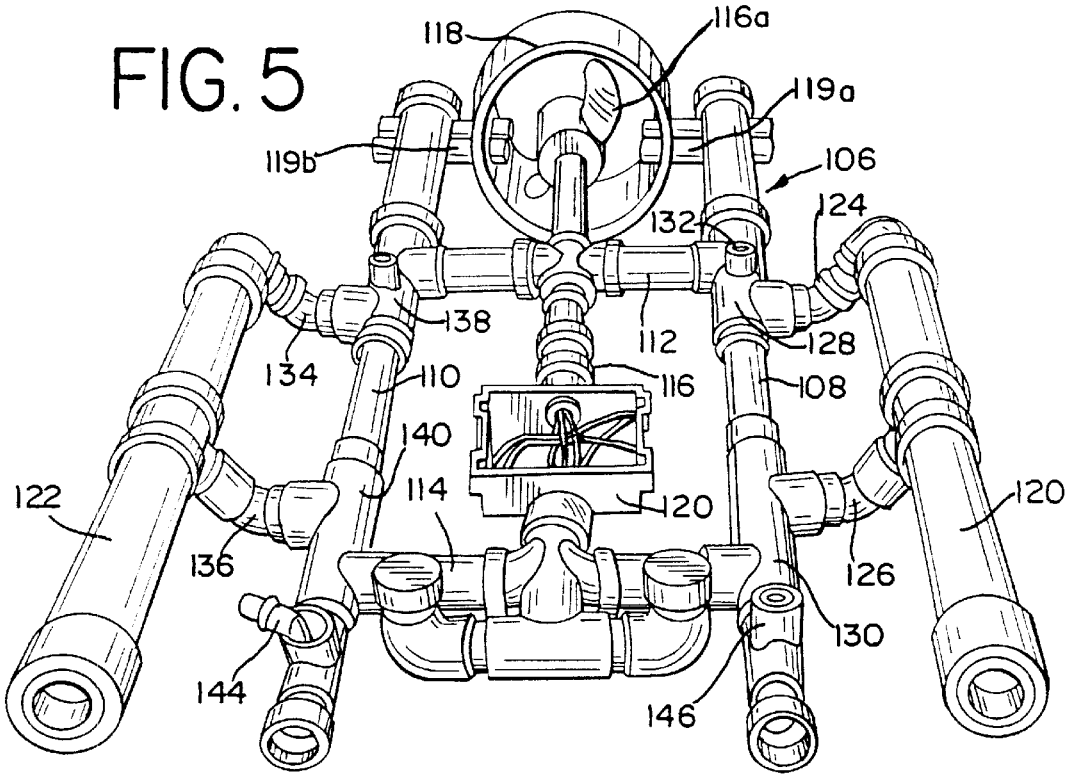
FIG. 5 is a perspective view of an alternative form of the underwater vehicle embodying the teachings of this invention and so constructed that it may be folded for transportation or storage.
Figure 6:
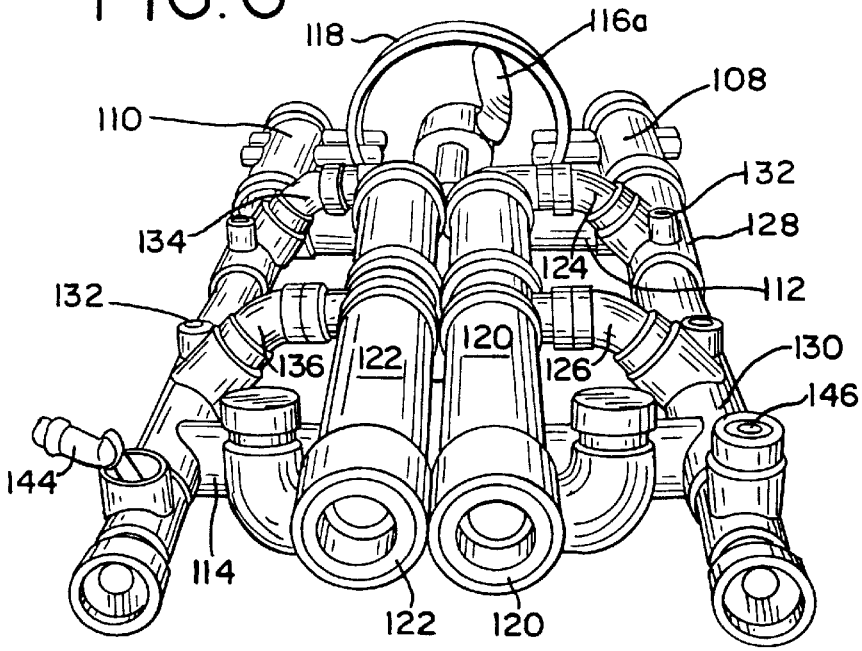
FIG. 6 is a perspective view of the alternative form of vehicle of FIG. 5, showing the buoyancy element folded inwardly.

In FIGS. 5 and 6 there is shown an alternate form of the underwater vehicle consisting of a tubular frame 106 including a pair of tubular members 108 and 110 connected by cross arms 112 and 114. All portions of the frame being constructed of hollow PVC tubing and consequently very light. Mounted between the cross arms 114 and 112 is a trolling motor 116 having propeller blades 116*a*. The propeller blades are surrounded by a protection cage 118 suitably connected to the rear portions of the tubular frame members 108 and 110 by braces 119*a* and 119*b*. At the forward end of the trolling motor 116 there is a junction box 120 and a battery (not shown) would be normally mounted on top of this junction box with its wires going into the junction box.

Figure 7:
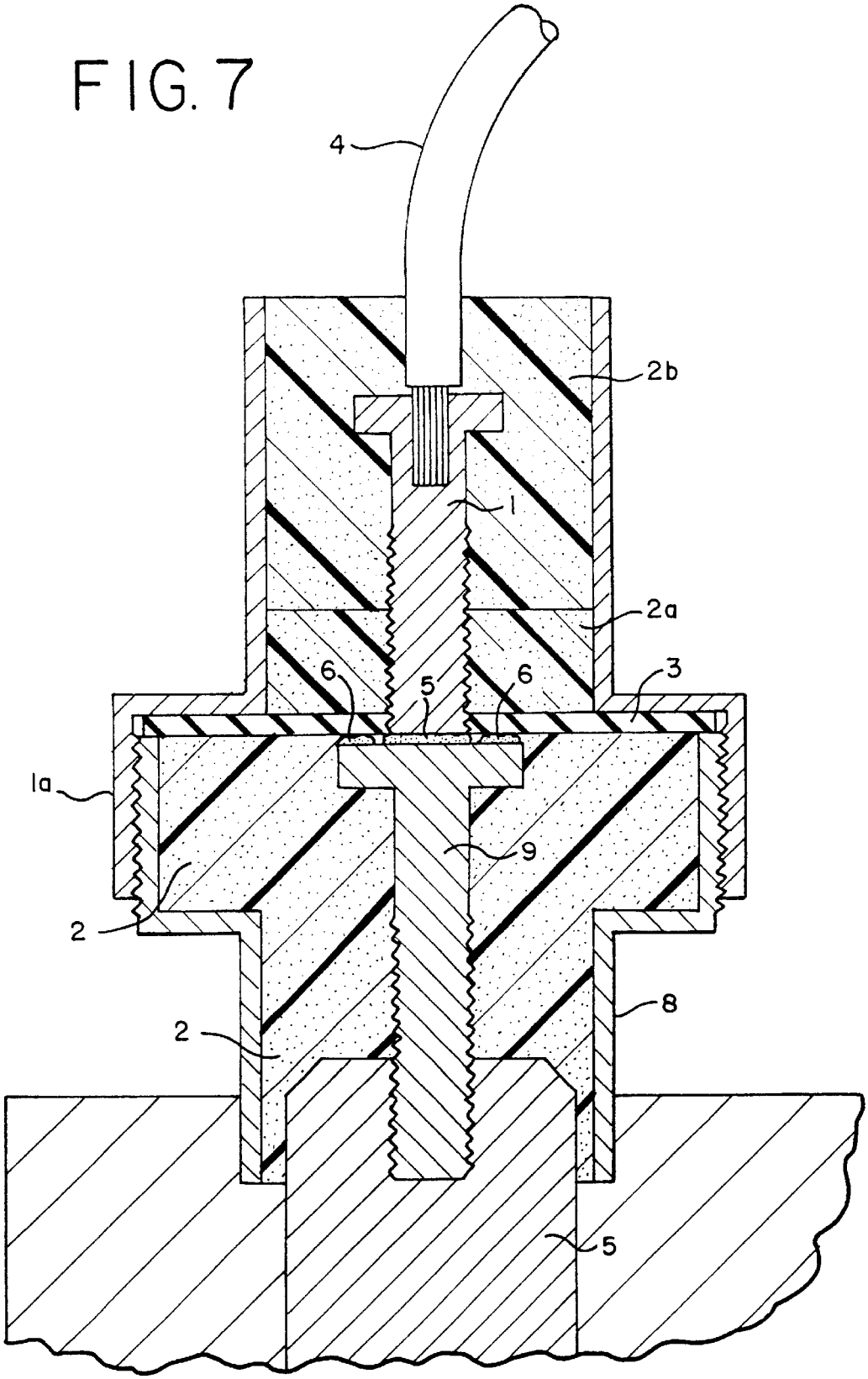
FIG. 7 a side elevational view of the watertight battery connection used in the vehicle.

As with the previous embodiment, the terminals for the battery could be covered and the interior of the junction box 120 could be filled with waterproof epoxy, thus preventing sea water from coming into contact with these wires or the terminals. However, an even better watertight battery connection shown in FIG. 7 uses a male threaded hose casing 8 that is hollow and is slipped over a brass threaded post stud 9 that has been screwed into the center of the battery 5 post. Epoxy 2 is then poured into all the voids to seal out moisture. The top of the brass threaded stud is flush with the top of the threaded casing and becomes a permanent part of the battery.

The female connector, a combination of a free spinning female internally threaded hollow hose casing 7 and a brass threaded post 1 that has been drilled out in the center about ¼ of an inch to accept a wire or battery cable 4. Epoxy 2*a* is poured into the top part of the female connector to about a quarter full. After that is set, a ¼ inch hole is drilled and tapped in the center of the epoxy 2*a* within the female connector. The threaded bolt 1 of brass or other conductive material is installed. The rubber washer 3 is installed and the internally threaded female hose casing 7 is then turned onto the externally threaded male hose casing just snug to create a seal. Then the brass threaded post 1 with wire or cable 4 attached is turned down to assure contact between the bolt 1 and the battery post stud 9, and the contact is tested. Then the second coat of epoxy 2*b* is poured into the female connector to the top, surrounding and sealing the post 1 and wire 4 and encapsulating all parts.

As wear occurs, the washer in the female side will compress and still make contact. A small amount of conductive grease 5 is put on the ends of male and female contacts and dielectric grease 6 may be put around the conductive grease to fill voids and keep corrosion and liquid out around the free spinning bottom portion 1 a of the female connector keeps the wire from turning and tangling and makes easy removal and connection for charging or replacement of the battery. Now the battery can be totally submerged in water. This also keeps out salt air which corrodes contacts and is a major problem with batteries in and around salt water and harsh environment.

The epoxy insulates and prevents arcing. The male and female hose casings can be made of brass, plastic or any desired materials.

Extending outwardly from the frame 106 are tubular buoyancy element housings 120 and 124. Buoyancy element housing 120 is connected to the tubular frame member 108 by means of connecting arms 124 and 126 affixed to sleeves 128 and 130 which surround the tubular frame member 108 and are movable relative thereto. The buoyancy element housing thus may be swung between an outwardly extended position as shown in FIG. 5 and an inwardly folded position as shown in FIG. 6. Set screw 132 or other suitable locking means may be employed to lock the arms in the desired position. In like manner the buoyancy element housing 122 is connected to the tubular member. 10 of the frame 106 by means of a pair of connecting arms 134 and 136 attached to sleeves 138 and 140 respectively. The sleeves 138 and 140 are mounted for rotation on the tubular member 110 and may be moved between an extended position as shown in FIG. 5 to an inwardly folded position as shown in FIG. 6. A set screw or push pin 142 may be used to lock the buoyancy element housing member in its desired position of orientation with respect to the frame.

A suitable motor control switch 144 may be provided on one side of this vehicle which is similar to the joys tick 32 of the embodiment of FIGS. 1 through 3 and a separate buoyancy control 146 permits the diver to adjust the buoyancy of the bladder within the buoyancy element housings 120 and 122. As in the previous embodiment the buoyancy element housings 120 and 122 are open at the ends for contact by the surrounding water so that the buoyancy elements therewithin are contacted by the water. If desired, the housings 120 and 122 may be a combination of rigid and resilient foam buoyancy elements and also the frame 106 may be filled with closed cell foam material or rigid material of the type previously described. Also, if desired, the buoyancy elements could be on the outside of the frame of the vehicle and thus not within any housing.

It will be readily apparent to those skilled in the art that a number of modifications can be made in the invention without departing from the spirit and scope of the invention which features expandable and contractible buoyancy elements which permit the buoyancy of the underwater vehicle change during the dive. By using rigid and resilient buoyancy elements which are open to and subjected to the pressure exerted on the dive vehicle by the water in which the dive vehicle is operating the buoyancy of the vehicle may be selectively or automatically adjusted. The novel way of protecting the interior of the housing and the seals from excessive strain by filling them with a non-compressible fluid and covering all electrical terminals with epoxy are also features of the invention. The vehicle can be made in a wide variety of forms other than those shown and described herein.

I claim:

1. An underwater dive vehicle comprising selectively energizable propulsion unit for forcibly driving said vehicle through the water, buoyancy means including at least one flexible, resilient and compressible first gas filled buoyancy element and at least one rigid foamed and substantially incompressible gas filled second buoyancy element, said buoyancy elements being unvalved and completely and permanently sealed against the passage of gas therefrom or water there into, in open contact with the surrounding water when said vehicle is in the water, the volume of gas in said first buoyancy element providing sufficient displacement of water to provide the desired amount of buoyancy at the surface, whereby when said vehicle is forced downwardly in the water by said propulsion unit the increasing water pressure will act upon and compress the buoyancy element and the gas contained therein reducing the volume of the gas and thus the buoyancy of the first buoyancy element, the volume of gas in said second buoyancy element providing sufficient displacement of water to provide a neutral buoyancy in the water.

2. An underwater dive vehicle comprising a shell which is normally open to permit water surrounding the vehicle to enter therein, at least one first buoyancy element formed of a resilient and compressible foamed plastic having discrete voids in which there is entrapped gas and at least one second buoyancy element formed of rigid and substantially incompressible foamed plastic having discrete voids in which there is entrapped gas, said first buoyancy element being disposed within said shell in direct contact with the water within said shell, the resiliency of said foamed buoyancy element being such that said element and the entrapped gas therein may be substantially compressed as the vehicle submerges, thereby reducing the buoyancy of said buoyancy element as the vehicle submerges and increasing the buoyancy as the vehicle ascends.

3. The underwater dive vehicle of claim 2 in which said first buoyancy element includes a bladder which is disposed within said normally open shell in direct contact with the water within said shell and selectively inflatable with gas to further increase the buoyancy of the vehicle.

4. The underwater dive vehicle of claim 2 in which there is a plurality second buoyancy elements selectively attachable to and removable from said vehicle, whereby the buoyancy of the vehicle may be adjusted by attaching or removing one or more second buoyancy elements to achieve neutral buoyancy of the vehicle in the water.

* * * * *